United States Patent [19]

Tomisawa

[11] Patent Number: 4,881,505

[45] Date of Patent: Nov. 21, 1989

[54] ELECTRONIC LEARNING CONTROL APPARATUS FOR INTERNAL COMBUSTION ENGINE

[75] Inventor: Naoki Tomisawa, Isesaki, Japan

[73] Assignee: Japan Electronic Control Systems Co., Ltd., Isesaki, Japan

[21] Appl. No.: 260,003

[22] Filed: Oct. 19, 1988

[30] Foreign Application Priority Data

| | | | |
|---|---|---|---|
| Oct. 20, 1987 | [JP] | Japan | 62-262782 |
| Oct. 20, 1987 | [JP] | Japan | 62-262783 |
| Oct. 20, 1987 | [JP] | Japan | 62-262784 |
| Oct. 20, 1987 | [JP] | Japan | 62-262791 |
| Oct. 20, 1987 | [JP] | Japan | 62-262793 |

[51] Int. Cl.[4] ..... F02M 51/00

[52] U.S. Cl. ..... 123/480; 123/489

[58] Field of Search ..... 123/480, 440, 486, 489, 123/478

[56] References Cited

U.S. PATENT DOCUMENTS

| | | | |
|---|---|---|---|
| 4,615,319 | 10/1986 | Tomisawa | 123/440 |
| 4,655,188 | 4/1987 | Tomisawa et al. | 123/489 |
| 4,703,430 | 10/1987 | Amano et al. | 123/480 |
| 4,715,344 | 12/1987 | Tomisawa | 123/489 |
| 4,729,359 | 3/1988 | Tomisawa et al. | 123/440 |
| 4,763,627 | 8/1988 | Tomisawa | 123/480 |

FOREIGN PATENT DOCUMENTS

| | | | |
|---|---|---|---|
| 0267765 | 5/1988 | European Pat. Off. | 123/480 |
| 0267764 | 6/1988 | European Pat. Off. | 123/480 |

*Primary Examiner*—Raymond A. Nelll

*Attorney, Agent, or Firm*—Foley & Lardner, Schwartz, Jeffery, Schwaab, Mack, Blumenthal & Evans

[57] ABSTRACT

Disclosed is an electronic learning control apparatus for an internal combustion engine, in which a basic control quantity corresponding to a target control value is corrected and computed by a feedback correction value to determine a control quantity and an objective parameter to be controlled is controlled by a static control quantity through control means. The entire deviation of the feedback correction value from a predetermined reference value is separated into deviations for respective error causes according to predetermined analysis rules, and a learning correction value for each error cause is computed according to the separated deviation for each error cause, and the basic control quantity is corrected based on the learing correction value for each error cause to obtain a final optimum control quantity. In this apparatus, the learning speed is increased and the learning correction precision can be improved.

20 Claims, 13 Drawing Sheets

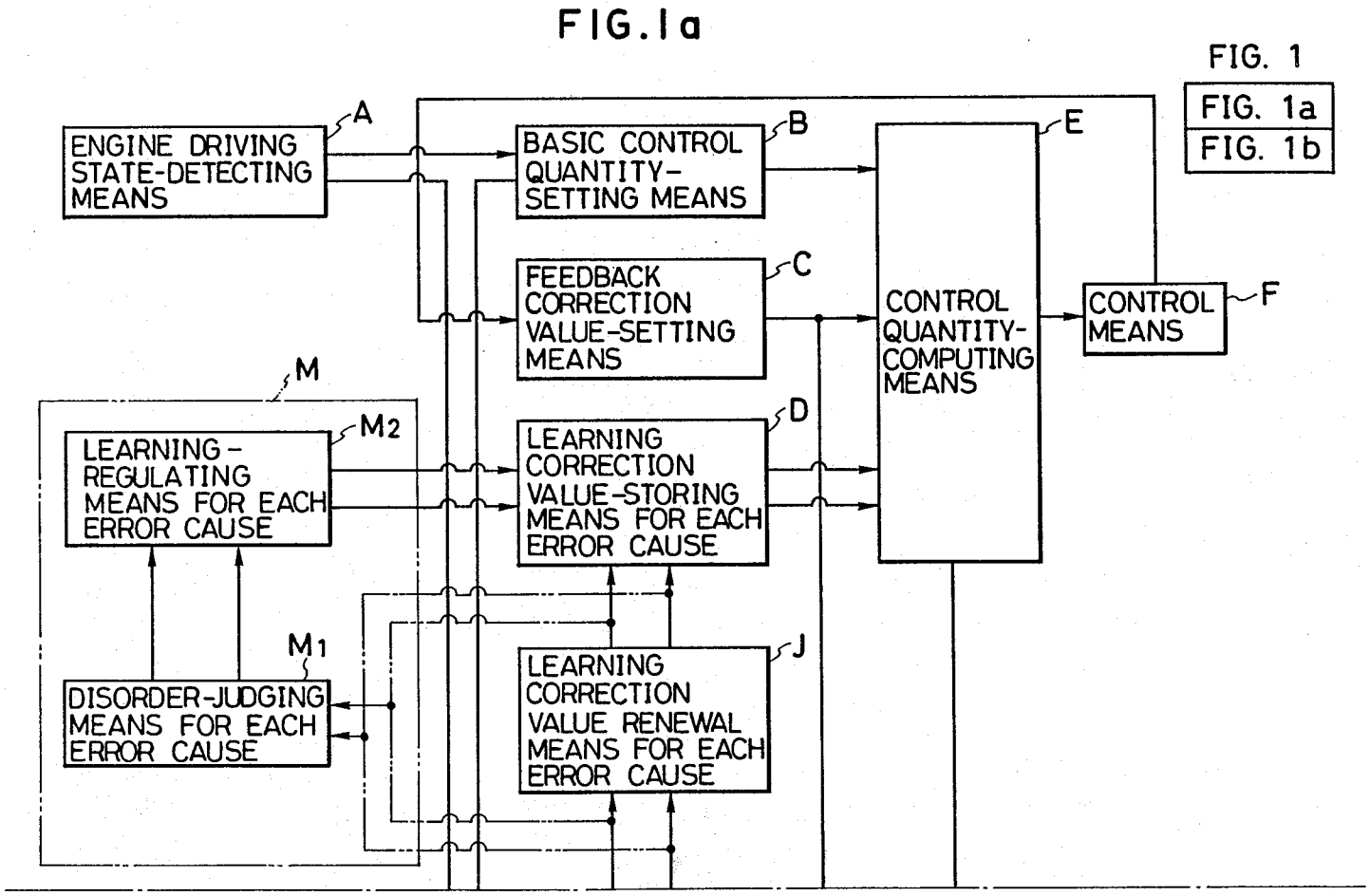
FIG. 1
FIG. 1a
FIG. 1b
FIG. 1a
A
ENGINE DRIVING STATE-DETECTING MEANS
B
BASIC CONTROL QUANTITY-SETTING MEANS
C
FEEDBACK CORRECTION VALUE-SETTING MEANS
D
LEARNING CORRECTION VALUE-STORING MEANS FOR EACH ERROR CAUSE
E
CONTROL QUANTITY-COMPUTING MEANS
F
CONTROL MEANS
J
LEARNING CORRECTION VALUE RENEWAL MEANS FOR EACH ERROR CAUSE
M
M2
LEARNING-REGULATING MEANS FOR EACH ERROR CAUSE
M1
DISORDER-JUDGING MEANS FOR EACH ERROR CAUSE

ELECTRONIC LEARNING CONTROL APPARATUS FOR INTERNAL COMBUSTION ENGINE

BACKGROUND OF THE INVENTION (1) Industrial Application Field

The present invention relates to a learning control apparatus for the feedback control of quantities of objective control factors such as an air-fuel ratio of a sucked airfuel mixture, a fuel injection quantity, an ignition timing, an idle revolution speed, a quantity of sucked auxiliary air, a supercharge pressure of air supplied to an engine from a supercharger, a self-diagnosis factor and an expectation factor in an internal combustion engine.

(2) Description of the Related Art

As the known learning control apparatus for an internal combustion engine, there can be mentioned apparatuses disclosed in U.S. Pat. Nos. 4,615,619, 4,655,188, 4,729,359 and 4,715,344 and U.S. patent application Nos. 97,682 (1987) and 98,038 (1987).

In these apparatuses, a basic control quantity set based on a target value of an objective control factor such as an air-fuel ratio according to the driving state of an engine is corrected and computed by a feedback correction value set by proportion control or integration control while comparing the actual value with the target value, and the objective control factor such as the air-fuel ratio is feedback-controlled to the target value based on this control quantity. The deviation of the feedback correction value from the reference value during the feedback control is learned for each area of the engine driving state to determine a learning value for each area, and in computing the control quantity, the basic control quantity is corrected by the learning value for each area and is computed without correction by the feedback correction value. In short, the control quantity computed without the feedback control is made equal to the target value. During the feedback control, the control quantity is computed by further correcting the so-obtained value by the feedback correction value.

According to this control system, during the feedback control, the follow-up delay of the feedback control at the transitional driving can be reduced, and at the stoppage of the feedback control, a desired control output can be obtained precisely.

Accordingly, deviations of constituent parts such as an electronically controlled fuel injection apparatus can be absorbed, and the change of a filling efficiency of the engine with the lapse of time and the changes of environmental conditions such as the atmospheric pressure, the temperature and the humidity can be corrected and the highest performance of the engine can be maintained over a long period.

In these conventional apparatuses, however, there is adopted a so-called repeated learning system using a data map, that is, a system in which data map lattice sections are set according to driving states of the engine, the feedback control deviation quantity is repeatedly renewed based on the learning experience for each learning area. Accordingly, in order to increase the learning correction precision, very fine learning area sections should be set, and hence, the renewal speed is inevitably reduced. In short, the learning correction precision and the learning speed are conditions contradictory to each other.

SUMMARY OF THE INVENTION

Under the above-mentioned background, it is a primary object of the present invention to provide an electronic learning control apparatus for an internal combustion engine, in which the above-mentioned problem involved in the conventional technique can be solved and the learning speed can be drastically increased while increasing the learning efficiency.

According to the present invention, there is provided an electronic feedback control apparatus in which the entire deviation (error quantity) of the feedback correction value from a predetermined reference value is detected, a plurality of error causes causing this entire deviation are analyzed according to analysis rules for the respective error causes to learn deviations for the respective errors, the learning values are stored, the control quantity is computed based on the basic control quantity, the feedback correction value and the learning value for each error cause, and control means is controlled based on the control quantity.

In this case, a plurality of learning correction values for the respective error causes may be divided into addition and multiplication terms and used for computation of the control quantity.

In order to learn the deviation for each error cause, the degree (satisfaction degree) to which the error cause satisfies the predetermined error cause in the analysis rule for each error cause may be calculated, the respective error causes may be weighted based on the calculated satisfaction degrees and the entire deviation may be separated into deviations for the respective error causes.

The analysis rule may be a rule for estimating the satisfaction degree of the error cause corresponding to at least one of the engine driving states such as the entire deviation, the change speed of the entire deviation, the change direction of the entire deviation, the value corresponding to the quantity of air sucked in the engine per unit revolution of the engine, the frequency of appearance of equal values of these factors during a predetermined period of time and the revolution speed of the engine.

Moreover, the learning correction values for the respective error causes may be calculated by obtaining weighted mean values of the learning correction values for the respective error causes, stored in the past, and the above-mentioned deviations for the respective error causes.

Furthermore, according to the present invention, there is provided an electronic learning control apparatus for an internal combustion engine, as set forth above, which is further characterized in that the basic control quantity is corrected and computed without performing the feedback correction based on new deviations for the respective error causes, analyzed by the error cause analyzing means, the obtained comparative control quantity is compared with the preceding control quantity obtained by computation by the control quantity computing means, it is judged based on the difference between said two control quantities whether or not the analysis result for each error cause is proper, and if this difference is large, the learning correction value is amended by increase or decrease for reducing the difference to compute said control quantity, whereby the precision is increased. In this case, there may be adopted a structure in which when the difference of the learning correction value for each error cause before and after the amendment is large, the analysis rule in the analysis means for each error cause is changed.

Moreover, according to the present invention, there may be adopted a structure in which when the learning correction value for each error cause exceeds the predetermined critical level for the judgement of an abnormal state, a necessary processing such as the judgement of an abnormal state or the regulation of the learning correction value to an upper limit or lower limit value thereof is performed.

In accordance with the fundamental aspect of the present invention for attaining the above-mentioned object, there is provided an electronic learning control apparatus for an internal combustion engine, which comprises, as shown in FIG. 1, engine driving state detecting means for detecting the driving state of the internal combustion engine, basic control quantity setting means for setting a basic control quantity corresponding to a target control value of an objective control factor, feedback correction value setting means for comparing the actual control value with the target control value and setting a feedback correction value for bringing the actual control value close to the target control value by increasing or decreasing the actual control value, rewritable learning correction value storing means for storing a learning correction value for each of a plurality of error causes, control quantity computing means for computing a control quantity by making a correction based on the learning correction value for each of the error causes according to a computing formula set for each of the error causes, control means for controlling the objective control factor of the internal combustion engine according to the computed control quantity, entire deviation detecting means for detecting the entire deviation of the feedback correction value from a predetermined reference value, error cause analyzing means for analyzing qualitatively and quantitatively a cause for producing an error in said entire deviation according to a predetermined analysis rule and separating the entire deviation into deviations of the respective error causes based on the analysis results, learning correction value setting means for computing and setting the learning correction value of each error cause based on the deviation of each error cause, and learning value renewal means for rewriting the learning correction value of each error cause stored in said storing means based on the set learning correction value of each error cause.

According to this basis aspect of the present invention, the basic control setting means B sets a basic control quantity corresponding to a target value of an objective control factor of an internal combustion engine, and the feedback correction value setting means C compares the actual value of the objective control factor with the target value and sets the feedback correction value by increasing or decreasing the actual value by proportion or integration control so that the actual value is brought close to the target value. The control quantity computing means E corrects the basic control quantity by the feedback correction value and computes the control quantity by making a correction according to an optimum computation formula set according to each of a plurality of learning correction values for the respective error causes, stored in the learning correction value storing means D for the respective error causes. The control means F is actuated based on the computed control quantity to control the objective control factor of the internal combustion engine.

Separately, deviation detecting means G detects the entire deviation of the feedback correction value from a predetermined reference value. The error cause analyzing means H performs inferential analysis based on various informations (such as the entire deviation quantity, the direction of the entire deviation, the speed of the entire deviation, the direction of the change of the entire deviation and other engine driving states) according to predetermined analysis rules and calculates the satisfaction degree of a specific error cause in each analysis rule. Each information is vaguely defined as the so-called fuzzy quantity and the fuzzy reasoning is conducted according to the analysis rule called "membership characteristic function". The entire deviation is separated into a plurality of deviations for the respective error causes based on the values determined based on the respective satisfaction degrees. The learning correction value setting means I computes and sets learning correction values for the respective error causes based on the deviations for the respective error causes. Based on said set values, the learning correction value renewal means J amends and rewrite the learning correction values for the respective error causes, stored in the storing means D.

According to the present invention, in the above mentioned manner, the entire deviation (error quantity) of the feedback control is detected, this entire deviation is separated into deviations for respective error causes according to the so-called fuzzy reasoning by using various informations and data bases and the basic control quantity is learned and corrected at a high precision according to a computation formula optimal to each error cause, whereby the precision of learning and correction and the learning speed can be reconciled with each other.

For attaining another object of the present invention, the means K for judging whether or not the error cause analysis result is proper and the error cause analysis amending means L for increasing or decreasing and amending the deviation for corresponding error cause based on the results of said judgement are added to the above-mentioned fundamental structure, and the means I for setting the learning correction value for each error cause uses this amended deviation for each error cause.

For attaining still another object of the present invention, the abnormal state-coping processing means M which is arranged so as to judge the excess of the learning correction value for each error cause over a predetermined value and perform an appropriate processing coping with this abnormal state is added to the above-mentioned fundamental structure.

The present invention will now be described in detail with reference to preferred embodiments illustrated in the accompanying embodiments, but it should be understood that the present invention is not limited to these embodiments but includes modifications and improvements within the scope of the object and technical idea of the present invention.

BRIEF DESCRIPTION OF THE DRAWINGS

FIGS. 1 and 1B are functional block diagrams illustrating the basic structure of an embodiment of the present invention.

DETAILED DESCRIPTION OF THE PREFERRED EMBODIMENTS

Embodiments of the learning control apparatus of the present invention, which are illustrated in the accompanying drawings, are those applied to the system of the feedback control of an air-fuel ratio of an air-fuel mixture sucked in an internal combustion engine having an electronically controlled fuel injection apparatus. In this case, the objective control factor is the air-fuel ratio and the controlled quantity is the fuel injection quantity.

Figure 2:
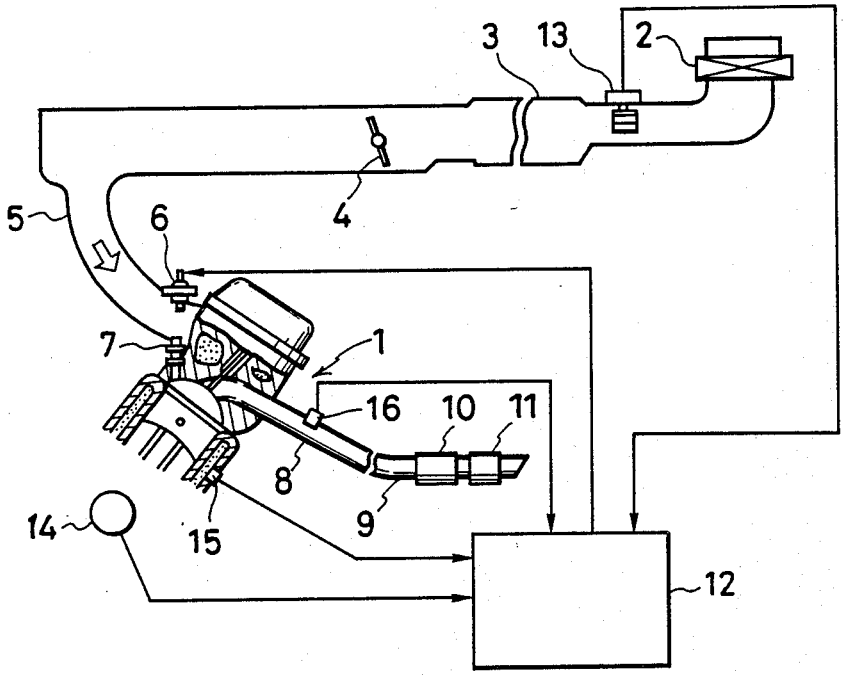
FIG. 2 is a system diagram of an internal combustion engine to which this embodiment of the present invention is applied.

Referring to FIG. 2, air is sucked into an engine 1 through a suction duct 3, a throttle valve 4 and an intake manifold 5 from an air cleaner 2. A fuel injection valve 6 is arranged as control means for each cylinder at a branch of the intake manifold 5. The fuel injection valve 6 is an electromagnetic fuel injection valve which is opened by energization of a solenoid and is closed by de-energization of the solenoid. Namely, the fuel injection valve 6 is energized and opened by a driving pulse signal from a control unit 12 described hereinafter, and a fuel fed under a pressure from a fuel pump not shown in the drawings and having the pressure adjusted to a predetermined level by a pressure regulator is injected and supplied into the engine. A multi-point injection system is adopted in the embodiment illustrated in FIG. 2, but there can be adopted a single-point injection system in which one common fuel injection valve for all the cylinders is arranged, for example, upstream of the throttle valve.

An ignition plug 7 is arranged in a combustion chamber of the engine 1, and the air-fuel mixture is burnt by spark ignition by the ignition plug 7.

An exhaust gas is discharged from the engine through an exhaust manifold 8, an exhaust duct 9, a ternary catalyst 10 and a muffler 11. The ternary catalyst 10 is an exhaust gas purging apparatus for oxidizing CO and HC in the exhaust gas, reducing $NO_x$ and converting them to other harmless substances, and the highest conversion efficiency is attained when the air-fuel mixture is burnt at a theoretical air-fuel ratio.

The control unit 12 comprises a micro-computer including CPU, ROM, RAM, and A/D converter and an input/output interface, and the control unit 12 receives input signals from various engine driving state detecting devices (sensors) and performs computing processings described hereinafter to control the operation of the fuel injection valve 6.

As one sensor, a hot-wire type or flap type air flow meter 13 is arranged in the intake duct 3 to put out a voltage signal corresponding to the sucked air flow quantity Q.

Furthermore, a crank angle sensor 14 is arranged, and in case of a 4-cylinder engine, the crank angle sensor 14 puts out a reference signal at every crank angle of 180° and a unit signal at every crank angle of 1° or 2°. The revolution number N of the engine can be calculated by measuring the frequency of the reference signals or the number of unit signals generated during a predetermined period.

Still further, a water temperature sensor 15 for detecting the temperature Tw of cooling water for a water jacket of the engine 1 is disposed.

Moreover, an $O_2$ sensor 16 is arranged at an assembling part of the exhaust manifold 8 to detect the air-fuel ratio of the air-fuel mixture sucked in the engine 1 through the $O_2$ concentration in the exhaust gas. Incidentally, precise detection becomes possible when an $O_2$ sensor provided with an $NO_x$-reducing catalyst, as proposed in EPO No. 267764A2 or EPO No. 267765A2, is used as the $O_2$ sensor 16.

Figure 3:
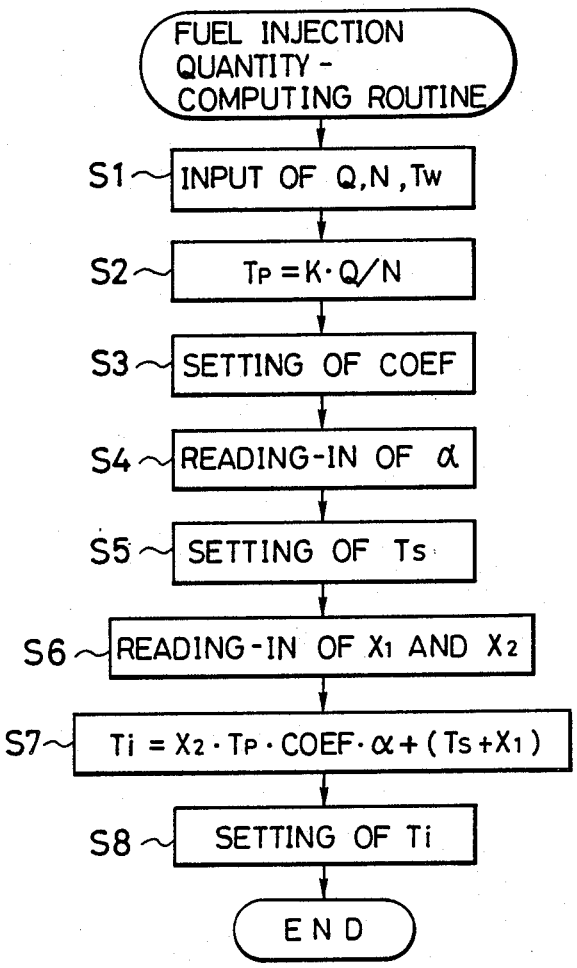
FIG. 3 is a flow chart of a routine for computing the fuel injection quantity, which illustrates the control content in the present invention.
Figure 4:
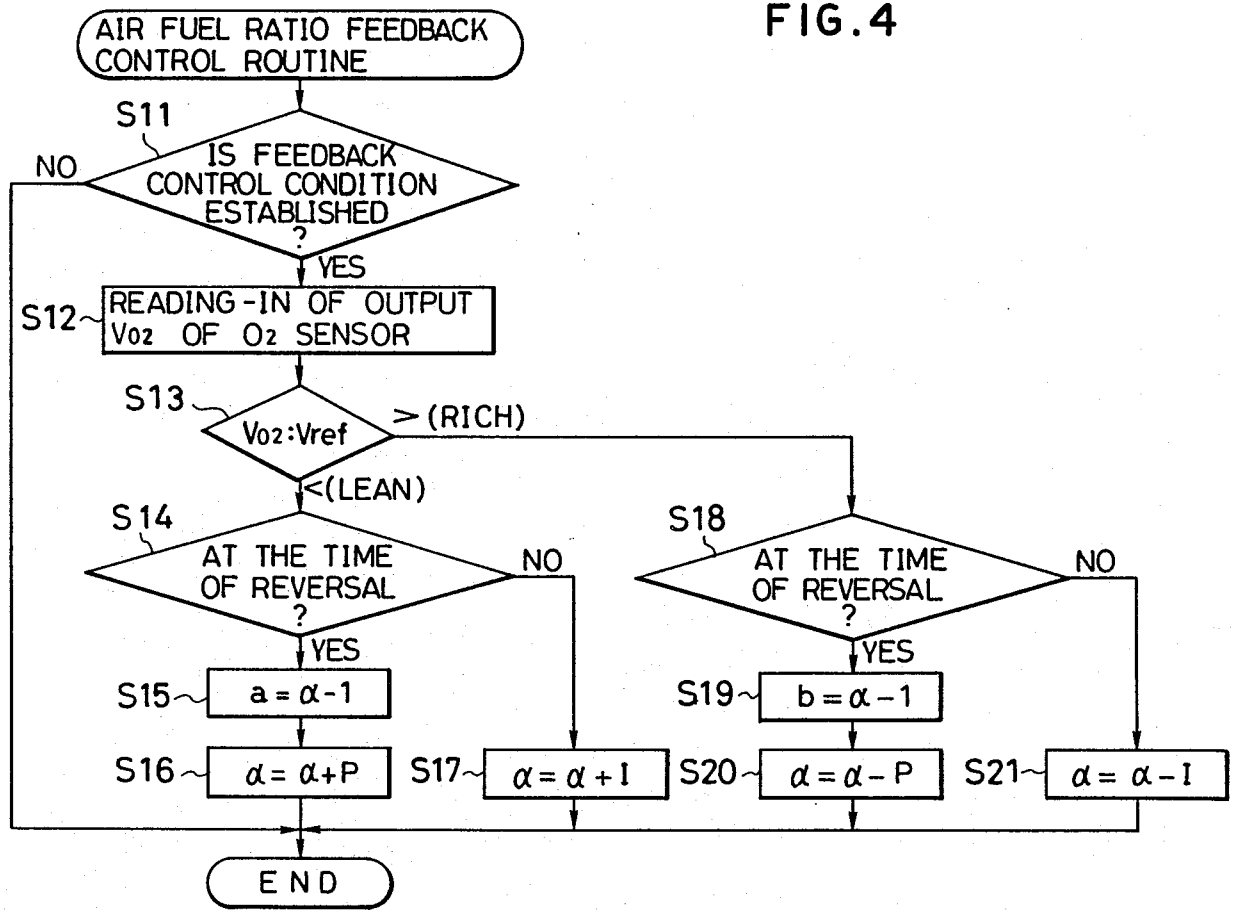
FIG. 4 is a flow chart of a routine for the feedback control of the air-fuel ratio, which illustrates the control content in the present invention.
Figure 5:
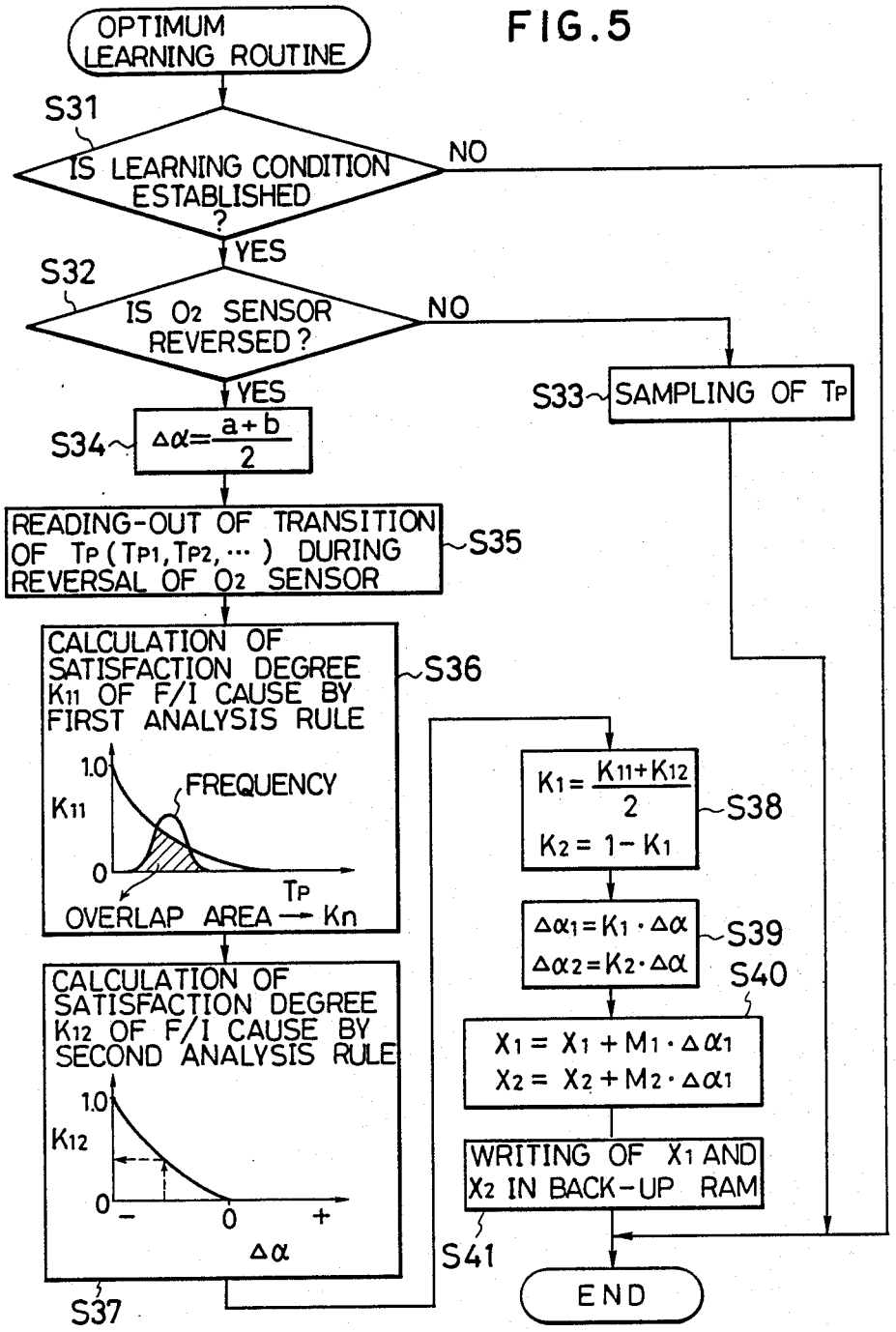
FIG. 5 is a flow chart of a learning control, which illustrates the control content in the present invention.

CPU of the micro-computer built in the control unit 12 performs computation processings according to programs on ROM (fuel injection quantity computing routine, air-fuel ratio feedback control routine and optimal learning routine), shown in the flow charts of FIGS. 3 through 5, to control the injection of the fuel.

Figure 1B:
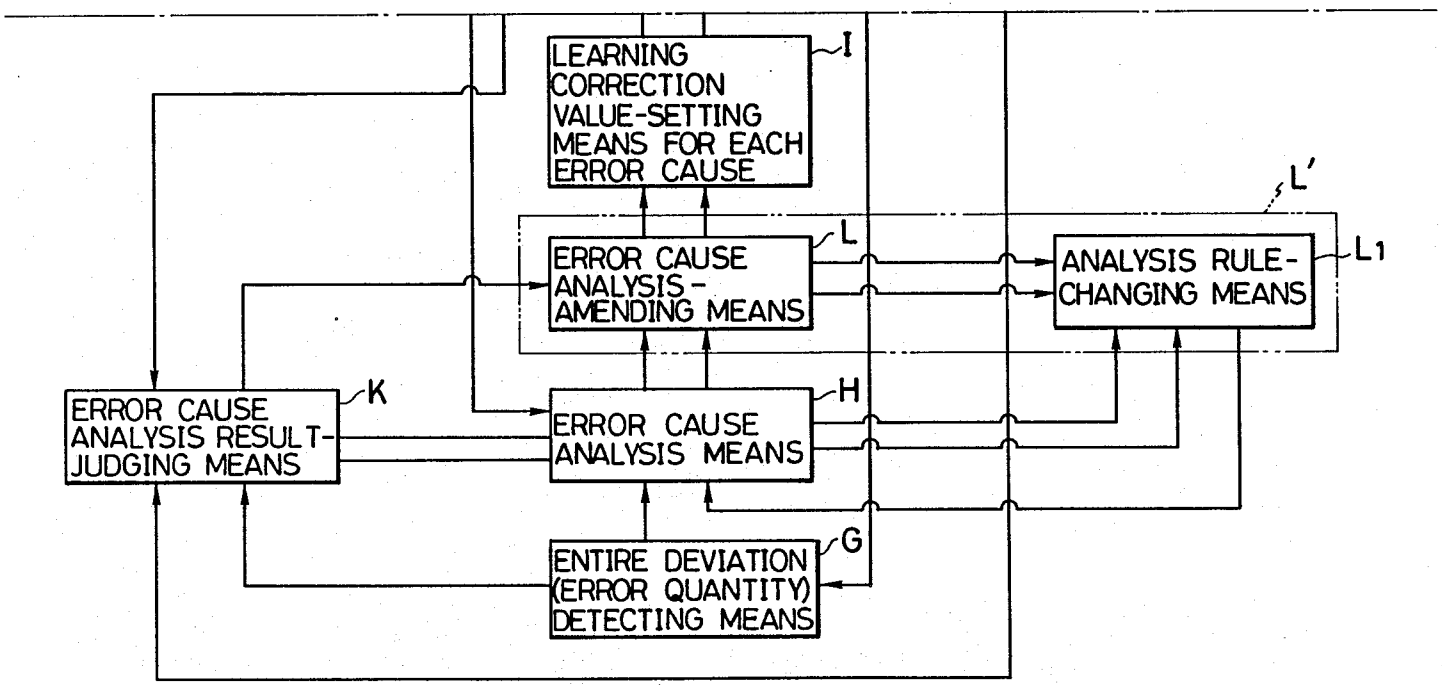

Incidentally, the functions of the basic control quantity setting means B, feedback correction value setting means C, control quantity computing means E, deviation detecting means G, error cause analysis means H, learning correction value setting means I for each error cause and learning correction value renewal means J for each error cause, shown in FIG. 1, are attained according to the above mentioned programs. Furthermore, RAM is used as the learning correction value storing means D for each error cause and the content of the memory is retained by a back-up power source even after an engine key switch has been turned off.

The computing processings of the micro-computer in the control unit 12 will now be described with reference to the flow charts of FIGS. 3 through 5.

FIG. 3 shows the fuel injection quantity computing routine, and this routine is carried out at a predetermined frequency.

At step 1 (indicated by "S1" in the drawings; the same will apply to subsequent step numbers), the sucked air flow quantity Q detected based on a signal from the air flow meter 13, the engine revolution number N calculated based on a signal from the crank angle sensor 14 and the water temperature Tw detected based on a signal from the water temperature sensor 15 are read in.

At step 2, the basic fuel injection quantity of $Tp=K.Q/N$ (K is a constant) corresponding to the quantity of air sucked per unit revolution number is computed from the sucked air flow quantity Q and the engine revolution number N. The portion of this step 2 corresponds to the basic control quantity setting means.

At step 3, various correction coefficients of $COEF=1+K_{TW}+K_{MR}+\ldots$, which include the water temperature correction coefficient $K_{TW}$ corresponding to the water temperature Tw and the air-fuel ratio correction coefficient $K_{MR}$ corresponding to the engine revolution number N and basic MR fuel injection quantity Tp, are set.

At step 4, a newest air-fuel ratio feedback correction coefficient $\alpha$ (reference value of 1) set by the air-fuel ratio feedback control routine of FIG. 4 described hereinafter is read in.

At step 5, the voltage correction portion Ts is set based on the battery voltage. This is to correct the change of the injection quantity of the fuel injection valve 6 by the change of the battery voltage.

At step 6, learning correction values $X_1$ and $X_2$ for each error cause is read in from a predetermined address of RAM as the learning correction value storing means D. Incidentally, when learning is not initiated, initial values of $X_1=0$ and $X_2=1$ are stored.

At step 7, the fuel injection quantity Ti is calculated according to the following formula:

$$Ti=X_2 \cdot Tp \cdot COEF\alpha+(Ts+X_1)$$

The portion of the step 7 corresponding to the control quantity computing means E.

At step 8, computed Ti is set in an output register. At a predetermined fuel injection timing synchronous with the revolution of the engine (for example, at every one revolution), a driving pulse signal having a pulse width of newly set Ti is given to the fuel injection valve 6 to effect the injection of the fuel.

FIG. 4 shows the routine for the feedback control of the air-fuel ratio, and this routine is carried out synchronously with the revolution or at a predetermined interval, whereby the air-fuel ratio feedback correction coefficient (value) is set. Accordingly, this routine corresponds to the feedback correction value setting means C.

At step 11, it is judged whether or not the predetermined air-fuel ratio feedback control condition is established. The predetermined air-fuel ratio feedback control condition referred to herein is a condition under which the engine revolution number N is below a predetermined value and the basic fuel injection quantity Tp expressing the load is below a certain value. If this condition is not satisfied, this routine is terminated. In this case, the air-fuel ratio feedback correction coefficient $\alpha$ is clamped at the precedent value (or the reference value of 1), and the air-fuel ratio feedback control is stopped. Namely, the air fuel ratio feedback control is stopped in a high-revolution or high-load region to obtain a rich output air-fuel ratio by the air-fuel ratio correction coefficient $K_{MR}$ and to control rising of the temperature of the exhaust gas, whereby the seizure of the engine 1 or the burning of the ternary catalyst 10 is prevented.

When the air-fuel ratio feedback control condition is established, the routine goes into step 12.

At step 12, the output voltage $V_{02}$ of the $O_2$ sensor 16 is read in, and at subsequent step 13, this output voltage is compared with the slice level voltage Vref corresponding to the theoretical air-fuel ratio and it is judged whether the air-fuel ratio is rich or lean.

When it is judged that the air-fuel ratio is lean ($V_{02}<V_{ref}$), the routine goes into step 14 from step 13, and it is judged whether or not the rich air-fuel ratio has just been reversed to the lean air-fuel ratio (just after the reversion). If the reversion is judged, the routine goes into step 15 and the entire deviation of the precedent airfuel feedback correction coefficient $\alpha$ from the reference value of 1 is stored as $a=b-1$ for the optimal learning routine of FIG. 5 described hereinafter. Then, the routine goes into step 16, the precedent air-fuel ratio feedback correction coefficient $\alpha$ is increased by the proportion constant P. When the non-reversion is detected, the routine goes into step 17 and the precedent air-fuel ratio feedback correction coefficient $\alpha$ is increased by the predetermined integration constant I. Thus the air-fuel ratio feedback correction coefficient $\alpha$ is increased at a certain gradient (by a certain amount). Incidentally, the condition of $P>I$ is established.

When the air-fuel ratio is rich ($V_{02}>V_{ref}$), the routine goes into step 18 from step 13, and it is judged whether or not the lean air-fuel ratio has just been reversed to the rich air-fuel ratio (just after the reversion). If the reversion is judged, the routine goes into step 19, and the entire deviation of the precedent air-fuel ratio feedback correction coefficient $\alpha$ from the reference value of 1 is stored as $b=a-1$ for the optimal learning routine of FIG. 5 described hereinafter. Then, the routine goes into step 20 and the precedent value of the air-fuel ratio feedback correction coefficient $\alpha$ is decreased by the predetermined proportion constant P. If the non-reversion is detected, the routine goes into step 21, and the precedent value of the air-fuel ratio feedback correction coefficient $\alpha$ is decreased by the predetermined integration constant I. Thus, the airfuel ratio feedback correction coefficient $\alpha$ is decreased at a certain gradient (by a certain quantity).

FIG. 5 shows the optimal learning routine, and this routine is carried out at every predetermined time to set and renew the learning correction values $X_1$ and $X_2$ for respective error causes.

At step 31, it is judged whether or not the predetermined learning condition is established. The predetermined learning condition is a condition under which the air-fuel ratio feedback control is being conducted and the rich/lean signal of the $O_2$ sensor 16 is reversed at an appropriate interval. If this condition is not established, the routine is terminated.

When the predetermined learning condition is established, the routine goes into step 32, and it is judged whether or not the output voltage $V_{02}$ of the $O_2$ sensor 16 has been reversed. If the non-reversion is judged, the routine goes into step 33, and the basic fuel injection quantity Tp at this time is sampled as the engine driving state data.

Figure 6:
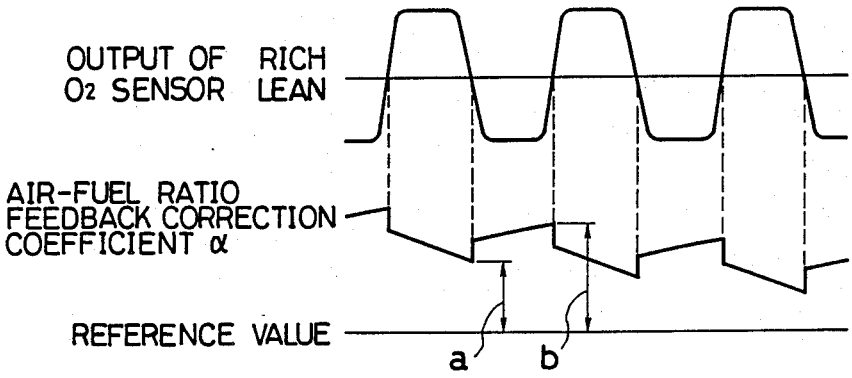
FIG. 6 is a diagram illustrating the state of the change of the air-fuel ratio feedback correction coefficient and the entire deviation of the feedback correction coefficient from the reference value in the present invention.

When the reversion of the output voltage $V_{02}$ of the $O_2$ sensor is judged, the routine goes into step 34 for the optimal learning, and the mean value of the above-mentioned a and b is determined. Incidentally, a and b are upper and lower peak values of the entire deviation of the air-fuel ratio feedback correction coefficient $\alpha$ from the reference value of 1 during the period between the reversions of the increase/decrease direction of the air-fuel feedback correction coefficient $\alpha$, as shown in FIG. 6. By calculating the mean value of a and b, the average entire deviation $\Delta\alpha$ of the air-fuel ratio feedback correction coefficient $\alpha$ is detected.

Accordingly, the portions of steps 15 and 19 shown in FIG. 4 and step 34 shown in FIG. 5 correspond to the entire deviation detecting means G.

Then, the error cause analysis is carried out. Incidentally, the error cause giving the entire deviation $\Delta\alpha$ is divided into the cause owing to the fuel injection valve 6 (hereinafter referred to as "F/I cause") and the cause owing to the air flow meter including the change of the air-density (hereinafter referred to as "Q cause").

At step 35, the transition (Tp1, Tp2, . . . ) of the basic fuel injection quantity Tp during the reversion of the output voltage $V_{02}$ of the $O_2$ sensor 16 is read in.

Then, the routine goes into step 36, and the satisfaction degree 11 (=0 to 1) to which the cause producing the entire deviation $\Delta\alpha$ is the F/I cause is calculated according to the first analysis rule.

More specifically, the basic fuel injection quantity Tp is plotted on the abscissa and the satisfaction degree is plotted on the ordinate, and according to the empirical rule that the influence of the fuel injection valve 8 is larger in a smaller injection quantity region, a graph of the satisfaction degree corresponding to the fuel injection quantity Tp is formed. A cumulative frequency distribution curve showing the frequency of appearance of equal values of the basic fuel injection quantity Tp for respective values sampled during the reversion of the $O_2$ sensor 16, which is formed to have a certain area, is overlapped on the above mentioned graph. The area of the overlapped portion (hatched portion in the drawings) to the entire area (1) of the cumula-frequency distribution curve is calculated, and the calculated value is designated as the satisfaction degree K11.

Then, the routine goes into step 37, and the satisfaction degree K12 to which the cause giving the entire deviation $\Delta\alpha$ is the F/I cause is calculated according to the second analysis rule.

More specifically, in case of the F/I cause, the deviation in the air-fuel ratio-enriching direction is generally caused by insufficient sealing of the fuel injection valve 6 or the like. Accordingly, the feedback control is the control toward the lean side, and hence, the entire deviation becomes a negative value. In case of Q cause, the deviation to the lean side is caused by contamination of the air flow meter or the like, and the entire deviation becomes a positive value. In view of this fact, a map in which the satisfaction degree is increased on the negative side of the entire deviation $\Delta\alpha$ is prepared, and the satisfaction degree K12 is retrieved according to the entire deviation $\Delta\alpha$ with reference to this map.

Figure 7:
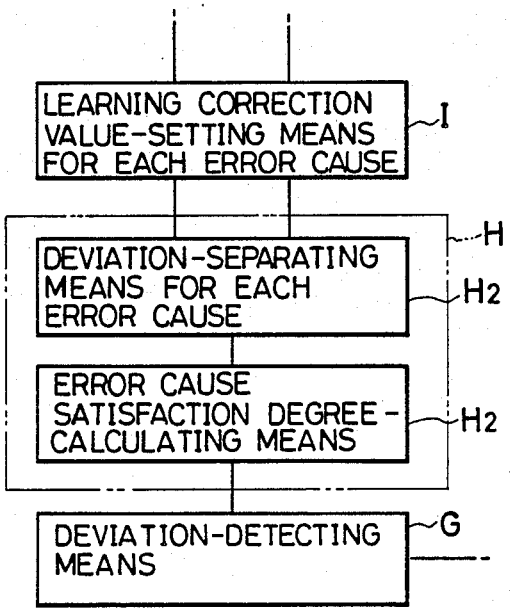
FIG. 7 is a functional block diagram of a part of the flow chart shown in FIG. 5, which illustrates one embodiment of the error cause analyzing means of the present invention.

The portions of steps 36 and 37 correspond to the error cause satisfaction degree calculating means H1 of the error cause analyzing means H shown in FIG. 7.

Then, the routine goes into step 38, and the mean value of K11 and K12 is calculated and is designated as the satisfaction degree K1 of the F/I cause [K1=(K11+K12)/2]. Supposing that the cause other than the F/I cause is the Q cause, the satisfaction degree K2 of the Q cause is expressed as $K_2=1-K_1$.

Thus, the entire deviation $\Delta\alpha$ can be separated into the deviation $K1\cdot\Delta\alpha$ owing to the F/I cause and the deviation $K2\cdot\Delta\alpha$ owing to the Q cause, and at subsequent step 32, the entire deviation is separated into deviations $\Delta\alpha1=K_1\Delta\alpha$ and $\Delta\alpha2=K_2\cdot\Delta\alpha$ for the respective error causes.

Accordingly, the portions of steps 38 and 39 correspond to the deviation separating means H2 for each error cause in the error cause analyzing means H.

Then, the routine goes into step 40, and the learning correction values $X_1$ and $X_2$ for the respective error causes, stored in the predetermined address on RAM are, read out. The learning correction value $X_1$ for the F/I cause, expressed by the following formula, is renewed by weighting $M_1$ to the deviation $\Delta\alpha$ for the F/I cause and the learning correction value $X_2$ for the Q cause, expressed by the following formula, is renewed by weighting $M_2$ to the deviation $\Delta\alpha2$ for the Q cause:

$$X_1=X_1+M_1\cdot\Delta\alpha1, \text{ and}$$

$$X_2=X_2+M_2\cdot\Delta\alpha2.$$

Then, the routine goes into step 41, and the learning correction values $X_1$ and $X_2$ for the respective error causes are written in the predetermined address on RAM. This RAM is a back-up memory and the memory content is retained even after the engine key switch has been turned off.

Accordingly, the portion of step 40 corresponds to the learning correction value setting mean I for each error cause, and the portion of step 41 corresponds to the learning correction value renewal means J for each error cause. Incidentally, the error cause analysis amending means L is not necessary in this case, and this means L is used when more precise control as described hereinafter is performed.

The learning correction value $X_2$ for the F/I cause and the learning correction value $X_2$ for the Q cause are determined in the above-mentioned manner. The correction based on these values is conducted according to the optimal computing formula for each error cause, as shown in step 7 of FIG. 3.

Namely, the computing formula is set by using the learning value $X_1$ for the F/I cause as the addition term to the basic fuel injection quantity Tp and the learning value $X_2$ for the Q cause as the multiplication term to the basic fuel injection quantity Tp. Optimal correction is performed according to this computing formula.

Figure 13:
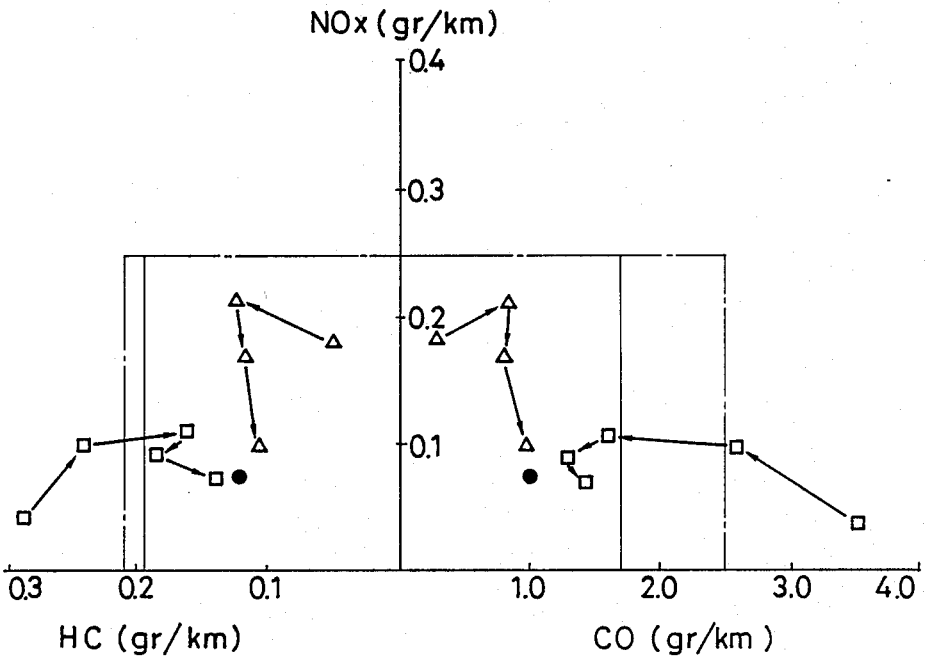
FIG. 13 is a diagram illustrating the effects of the learning control according to the present invention.

FIG. 13 shows the effects attained in the foregoing embodiment of the present invention. Namely, FIG. 13 shows that in an engine where the air-fuel ratio is rich by about +16% as indicated by mark "$\upsilon$", if learning is conducted about 4 times, the value is brought close to the central value of the dispersion indicated by mark "•", and that in an engine where the air-fuel ratio is lean by about −16% as indicated by mark "Δ", if learning is conducted about three times, the value is brought close to the central value of the dispersion indicated by mark "•". It is clear that the learning speed is highly improved by the learning according to the present embodiment.

In the present embodiment, a fuel injection apparatus of the so-called L-Jetro system having an air flow meter and detecting the sucked air flow quantity is shown as the electronically controlled fuel injection apparatus. However, the present invention can be similarly applied to other various air-fuel ratio control systems such as the so-called D-Jetro system detecting the negative pressure of the suction manifold and the $\alpha$-N system detecting the throttle valve opening degree ($\alpha$) and the engine revolution number (N).

The present invention can be applied to not only the feedback control of the air-fuel ratio but also other electronic feedback controls for an internal combustion engine, such as the ignition timing detecting control detecting the knocking, the feedback control of the idle revolution speed conducted through an auxiliary air valve, the feedback control of the supercharge pressure in a supercharger-equipped engine and various self-diagnosis and expectation feedback controls.

As is apparent from the foregoing description, according to the present invention, learning for respective areas, conducted in the conventional technique, is not carried out but learning for each error cause is performed by analyzing error causes producing a deviation according to predetermined analysis rules. Accordingly, the learning speed can be highly improved without reduction of the precision of learning and correction. Moreover, by this learning control, such effects as reduction of the number of matching steps, simplification of the maintenance of parts and realization of the maintenance-free can operation be attained. Furthermore, the capacitance of the back-up memory can be reduced.

Various modifications of the foregoing embodiment will now be described.

The error cause satisfaction degree calculating means $H_1$ of the error cause analyzing means H shown in FIGS. 1 and 7 calculates the satisfaction degree for each error cause according to analysis rules determined according to a plurality of engine driving states. The control of these analysis rules will now be described with reference to FIGS. 8 and 9.

Figure 8:
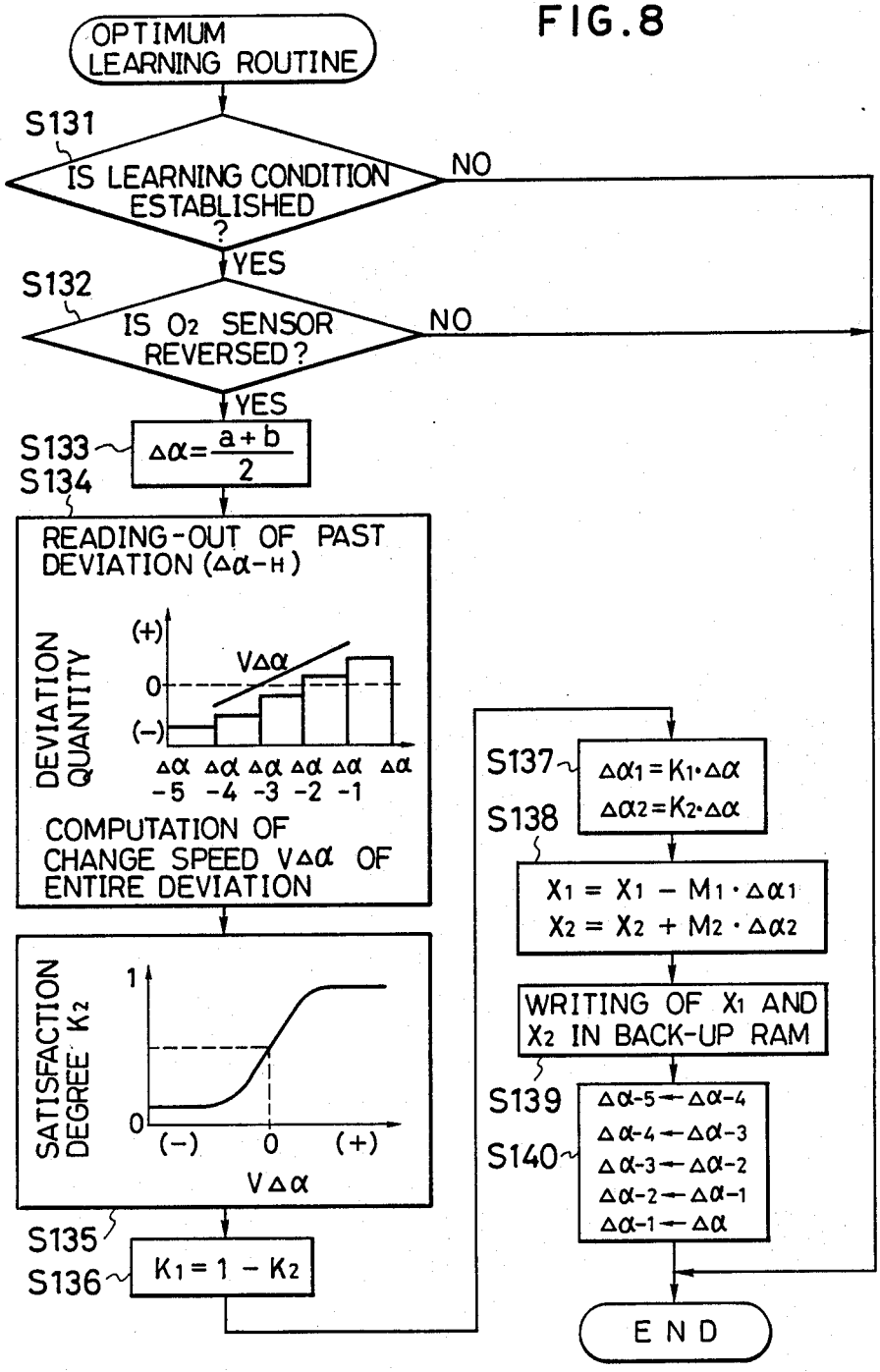
FIG. 8 is a flow chart of the learning routine including another embodiment of the error cause analyzing means of the present invention.

FIG. 8 shows the analysis rule for determining the satisfaction degree of the error cause according to the speed of the change of the entire deviation of the feedback correction value from the reference value. Steps 131 through 133 are the same as steps 31 through 34 shown in FIG. 5.

At step 134, the entire deviation $\Delta\alpha$-H in the past (the five deviations $\Delta\alpha$-5 through $\Delta\alpha$-1 in the past in this example) is read out, and the change speed ($V\Delta\alpha = \Delta\alpha$-1 -$\Delta\alpha$-5) of the entire deviation is calculated. The direction of the change is indicated by the positive or negative of $V\Delta\alpha$.

Then, the routine goes into step 135, and the satisfaction degree $K_2$ (=0 to 1) to which the cause giving the entire deviation $\Delta\alpha$ is the Q cause is retrieved from the change speed V4 of the entire deviation with reference to the map.

This map is formed, for example, based on an interference that (i) $V\Delta\alpha$ is large (this is not due to deterioration of a part because the advance of deterioration of a part is slow) and (ii) $V\Delta\alpha$ is in the positive (+) direction, the driving satisfying these conditions (i) and (ii) is a driving on a high land and hence, the cause giving the entire deviation is the Q cause by the change of the density of air.

Then, the routine goes into step 136, and based on the assumption that the cause other than the Q cause is the F/I cause, the satisfaction degree ($K_1 = 1 - K_2$) to which the cause giving the entire deviation $\Delta\alpha$ is the F/I cause is computed.

Thus, the entire deviation $\Delta\alpha$ can be separated into the deviation $K_1 \cdot \Delta\alpha$ by the F/I cause and the deviation $K_2 \cdot \Delta\alpha$ by the Q cause. The portions of steps 134 through 136 correspond to the error cause satisfaction degree calculating means $H_1$.

Steps 137 through 140 are substantially the same as steps 39 through 41 shown in FIG. 5. At step 140, the entire deviation $\Delta\alpha$-H of the five deviations in the past is temporarily stored and the stored value is rewritten to a new value in succession. Accordingly, at step 134 of the next operation, calculation of the entire deviation $V\Delta\alpha$ is possible.

Figure 9:
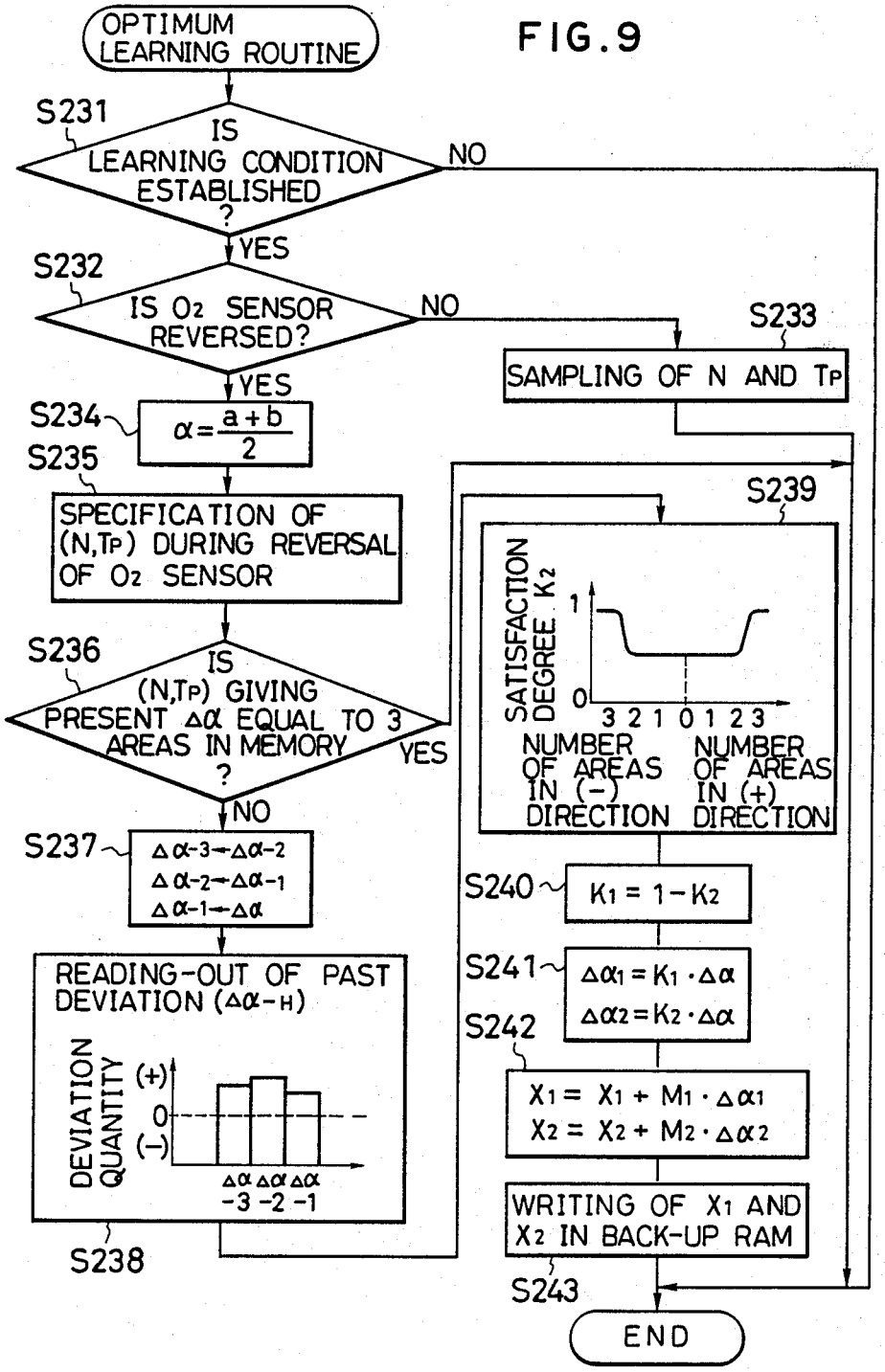
FIG. 9 is a flow chart of a learning routine including still another embodiment of the error cause analyzing means of the present invention.

The analysis rule shown in FIG. 9 is a rule for determining the satisfaction degree of the error cause based on the direction of the entire deviation in a plurality of different driving state areas determined according to a plurality of driving states of the engine.

Step 231 through 234 are the same as steps 31 through 34 shown in FIG. 5.

At step 235, the transitions of the engine revolution number N and basic fuel injection quantity Tp ($N_1$, $N_2$, ... and $Tp_1$, $Tp_2$, ...) during the reversion of the output voltage $V_{02}$ of the $O_2$ sensor are read out, and a plurality (three in this example) of areas of the engine driving state (N and Tp) are specified.

Then, the routine goes into step 236, and it is judged which of the three stored area is equal to the area of the engine driving state (N and Tp) giving the present entire deviation $\Delta\alpha$, and if there is present an equal area, this routine is terminated.

If there is not any equal area, the routine goes into step 237, and the following operations are carried out and the entire deviation $\Delta\alpha$-H for each of three areas of the different engine driving states (N and Tp) is temporarily stored:

$$\Delta\alpha-3 \rightarrow \Delta\alpha-2$$

$$\Delta\alpha-2 \rightarrow \Delta\alpha-1$$

$$\Delta\alpha-1 \rightarrow \Delta\alpha$$

Incidentally, the number of areas to be stored is not limited to 3.

At step 238, the entire deviation $\Delta\alpha$-H ($\Delta\alpha$-3 through $\Delta\alpha$-1) of the areas of the three different engine driving states (N and Tp) in the past is read out.

Then, the routine goes into step 239, the number of areas in which the entire deviation $\Delta\alpha$-H is in the positive (+)or negative (−) direction is examined, and the satisfaction degree $K_2$ (=0 to 1) to which the cause giving the entire deviation −H is the Q cause is retrieved with reference to the map.

This map is prepared based on an interference that if many areas have deviations −H in the same direction, the cause giving the entire deviation is the Q cause by the change of the density of air.

Then, the routine goes into step 240, and based on the assumption that the cause other than the Q cause is the F/I cause, the satisfaction degree ($K_1 = 1\ K_2$) to which the cause giving the entire deviation $\Delta\alpha$ is the F/I cause is computed.

In the above-mentioned manner, the entire deviation$\Delta\alpha$ can be divided into the deviation $K_1 \cdot \Delta\alpha$ by the F/I cause and the deviation $K_2 \cdot \Delta\alpha$ by the Q cause. Accordingly, steps 235 through 240 correspond to the error cause calculating means $H_1$.

Steps 242 through 243 are the same as steps 39 through 41 shown in FIG. 5.

Figure 10A:
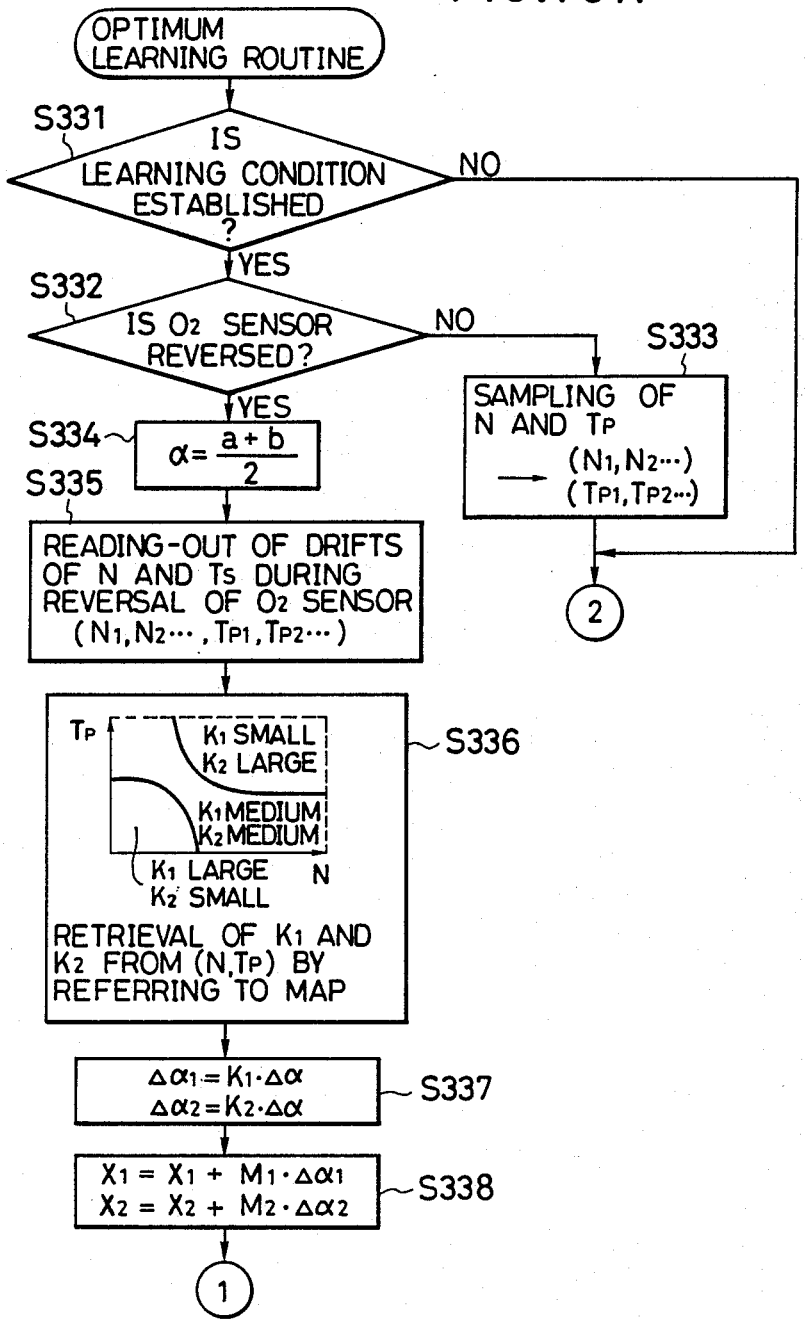
FIGS. 10(A) and 10(B) show flow charts of an optimal learning routine, which illustrates another control content.
Figure 10B:
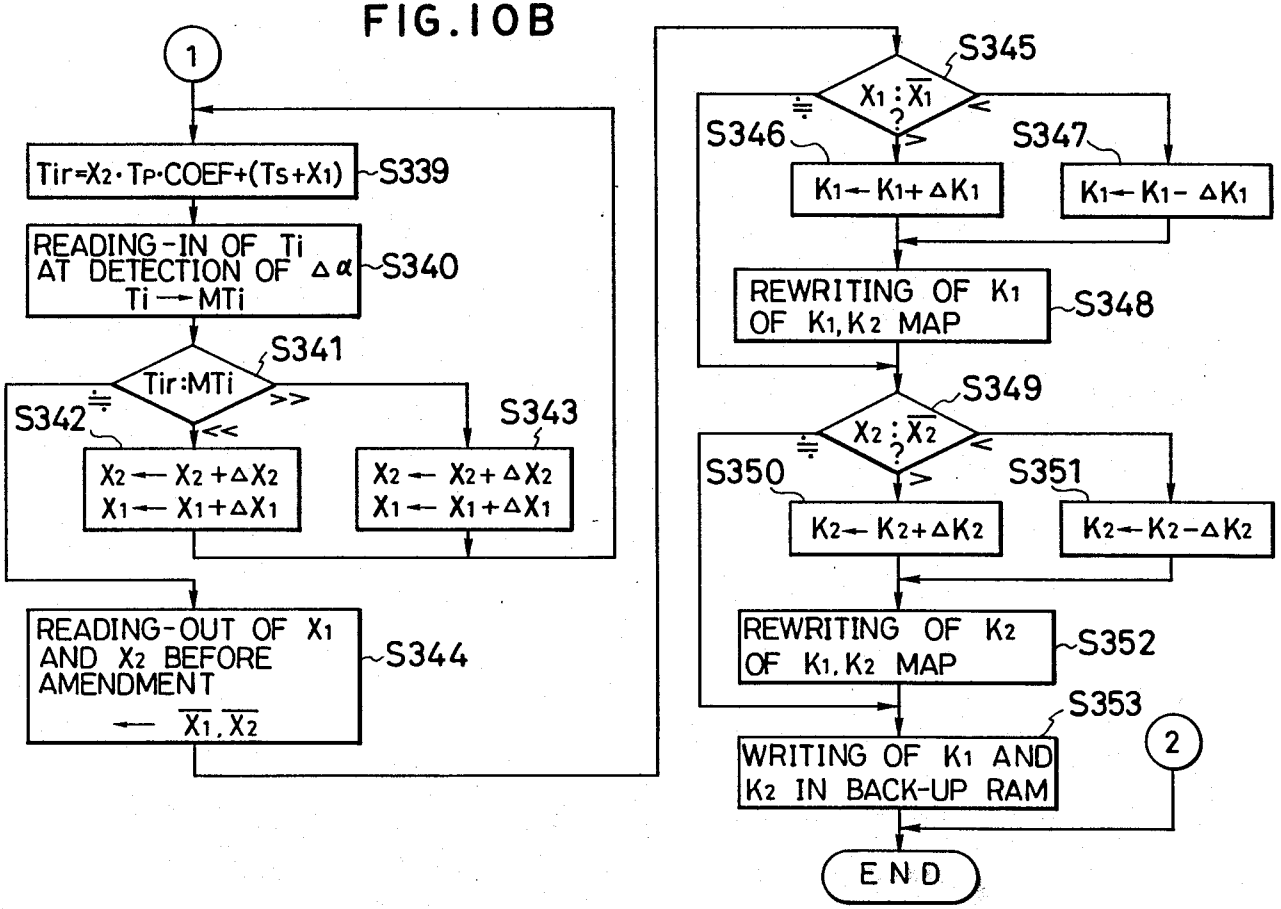

FIGS. 10(A) and 10(B) illustrate an embodiment in which in the foregoing embodiments, the error cause analysis result is judged and amended and, if necessary, the analysis rule to be used for the analysis of the error cause is properly changed, whereby the control precision is further increased. Error cause analysis result judging means K, error cause analysis amending means L or L' and analysis rule changing means $L_1$ shown in FIG. 1 will be mainly described here. Other structural features are the same as those described hereinbefore.

In FIGS. 10(A) and 10(B), steps 331 through 338 and step 353 are substantially the same as steps 231 through 243 shown in FIG. 9, but step 336 indicates a modification of the error cause satisfaction degree calculating means $H_1$ corresponding to steps 253 through 240 shown in FIG. 9. Namely, at step 336, learning weighting satisfaction degrees $K_1$ and $K_2$ for respective error causes, which are allocated to respective areas of the engine driving state (N and Tp), are retrieved with reference to the map. Incidentally, the initial value of $(K_1+K_2)$ is smaller than 1. From the empirical rule, it is estimated that in the low-revolution and low-load region, the F/I cause is large and in the high-revolution and high-load region, the Q cause is large, and the values of $K_1$ and $K_2$ are alloted to each area. By referring to this map, the satisfaction degree of the error cause is analyzed based on the engine driving state.

Step 339 shown in FIG. 10(B) and other steps will now be described in sequence. By using the learning correction values $X_1$ and $X_2$ for each new error cause, renewed at step 338, the comparative fuel injection quantity Tir is computed. As shown below, the air-fuel ratio feedback correction coefficient $\alpha$ is not given in the formula for calculation of the comparative fuel injection quantity Tir, and the comparative fuel injection quantity (comparative control quantity) Tir is computed by using the presently renewed learning correction values $X_1$ and $X_2$ for each error cause without the feedback correction coefficient $\alpha$:

$$Tir=X_2 \cdot Tp \cdot COEF+(Ts+X_1)$$

At subsequent step 340, by using the precedent learning correction values $X_1$ and $X_2$ for each error cause, the precedent fuel injection quantity (precedent control quantity) Ti computed according to the fuel injection quantity computing routine shown in FIG. 3 is read in, and this value is designated as MTi. The precedent fuel injection quantity MTi is, for example, a mean value of the fuel injection quantities Ti obtained at the upper and lower peak values of the air-fuel ratio feedback correction coefficient $\alpha$.

Then, the routine goes into step 341, and the comparative fuel injection quantity Ti computed at step 339 without using the air-fuel ratio feedback correction coefficient $\alpha$ is compared with the precedent fuel injection quantity MTi set by using the air-fuel ratio feedback correction coefficient $\alpha$ and it is judged whether or not the error cause analysis is right. Accordingly, the portions of steps 339 through 341 correspond to the error cause analysis result judging means K.

If it is judged that Ti is nearly equal to MTi, it is judged that if the learning correction values $X_1$ and $X_2$ for each error cause, which are now renewed after the analysis of the error cause, are used, the fuel can be injected and supplied to the engine 1 in an amount corresponding to the computed fuel injection quantity Ti even without using the feedback correction coefficient $\alpha$ and an air-fuel mixture having an air-fuel ratio almost equal to the theoretical airfuel ratio can be obtained. The reason is as follows.

Since the air-fuel ratio feedback correction coefficient is set so as to bring the actual air-fuel ratio to the theoretical air-fuel ratio which is the target air-fuel ratio, the precedent fuel injection quantity MTI read in at step 340 can be regraded as being substantially equal to the theoretical air-fuel ratio, and if the comparative fuel injection quantity Tir computed by using the learning correction values X1 and X2 for each error cause, obtained from the present error cause analysis result, without using the air-fuel ratio feedback correction coefficient $\alpha$ is substantially equal to the precedent fuel injection quantity MTi corresponding to the theoretical air-fuel ratio, the target theoretical air-fuel ratio is substantially obtained from the error cause analysis result without using the air-fuel ratio feedback correction coefficient $\alpha$ and it is seen that the error cause is correctly analyzed and learning is proper.

In the case where Tir>MTi or Tir>MTI is judged at seep 341, if the fuel injection quantity Ti is computed without using the air-fuel ratio feedback correction coefficient $\alpha$ by using the learning correction values X and $X_2$ for each error cause, obtained at 338 by the present analysis of the error cause, the target theoretical air-fuel ratio cannot be obtained. More specifically, if the comparative fuel injection quantity Ti computed at step 339 is smaller than the fuel injection quantity MTi obtained by the feedback correction of the air-fuel ratio, at the time of setting the actual fuel injection quantity Ti, it is necessary to increase and amend the fuel injection quantity Ti by the air-fuel ratio feedback correction coefficient. On the other hand, if the comparative fuel injection quantity Tir computed at step 339 is larger than the fuel injection quantity MTi, it is necessary to decrease and correct the fuel injection quantity Ti by the air-fuel ratio feedback correction coefficient $\alpha$.

In the state where the fuel injection quantity is corrected to the fuel injection quantity Ti corresponding to the theoretical air-fuel ratio by the air-fuel feedback correction coefficient $\alpha$, it can be said that the error cause analysis result is not good. In this case, the routine goes into step 342 or step 343, the learning correction values $X_1$ and $X_2$ for each error cause are increased or decreased and amended in the following manner so that the fuel injection quantity Ti corresponding to the theoretical air-fuel ratio can be obtained without the air-fuel ratio correction coefficient $\alpha$.

In the case where Tir>MTi is judged at step 341, if the fuel injection quantity Ti is computed without using the airfuel ratio feedback correction coefficient by using only the learning correction coefficient $\alpha$ by using only the learning correction values $X_1$ and $X_2$ for each error cause obtained at step 338, the quantity of the fuel is insufficient and the air-fuel ratio is lean. Accordingly, the routine goes into step 342, and minute values $\Delta X_1$ and $\Delta X_2$ are added to the learning correction values $X_1$ and $X_2$ for each error cause obtained at step 338 to obtain new learning correction values $X_1$ and $X_2$ for each error ($X_1 \rightarrow X_1+\Delta X_1$, $X_2 \rightarrow X_2+\Delta X_2$) and to increase and correct the fuel injection quantity by the learning correction values $X_1$ and $X_2$. Then, the routine returns to step 339. Namely, the amendment of the learning correction values $X_1$ and $X_2$ for each error cause at 342 is repeated until Tir becomes nearly equal to MTi.

In the case where Tir→MTi is judged at step 341, if the fuel injection quantity Ti is computed without using the air-fuel ratio feedback correction coefficient $\alpha$ by using only the learning correction values $X_1$ and $X_2$ for each error cause obtained at step 338, the quantity of the fuel is excessive and the air-fuel ratio is rich. Accordingly, the routine goes into step 343, and minute values $\Delta X_1$ and $\Delta X_2$ are subtracted from the learning correction values $X_1$ and $X_2$ for each error cause obtained at step 338 to obtain new learning correction values $X_1$ and $X_2$ for each error cause ($X_1 \rightarrow X_1 - \Delta X_1$, $X_2 \rightarrow X_2 - \Delta X_2$) and to decrease and amend the fuel injection quantity Ti by the learning correction values $X_1$ and $X_2$ for each error cause. Then, the routine returns to step 339, and the amendment of the learning correction values $X_1$ and $X_2$ for each error cause at step 343 is repeated until Tir becomes nearly equal to MTi.

In the case where the learning correction values $X_1$ and $X_2$ are amended at step 342 or step 343 so that it is judged at step 341 that Tir is nearly equal to MTi, or in the case where the analysis of the error cause is properly performed and by using the learning correction values $X_1$ and $X_2$ for each error cause obtained at step 338, it is judged at step 341 that Tir is nearly equal to MTi, the routine goes into step 334, and the learning correction values $X_1$ and $X_2$ for each error cause before the amendment (the values set at step 338) are read out and designated as $\overline{X}_1$ and $\overline{X}_2$.

At subsequent step 345, the finally obtained learning correction value $X_1$ is compared with $\overline{X}_1$ mentioned above. In the case where by the first operation at step 341, it is judged that Tir is nearly equal to MTi, the finally obtained learning correction value $X_1$ for each error cause is the value set at step 338, and in the case where it is judged that Tir is not equal to MTi, the finally obtained learning correction value $X_1$ is the amended value finally obtained at step 342 or step 343.

If it is judged at step 345 that $X_1$ is nearly equal to $\overline{X}_1$, it is meant that the amendment is small or the amendment is not performed at step 342 or step 343. Accordingly, the routine jumps over steps 346 through 348 and goes into step 349. If it is judged that $\overline{X}_1$ is not equal to $X_1$, it is meant that the amendment by increase or decrease is made beyond a predetermined level, and therefore, the routine goes into step 346 or step 347 and learning-weighting satisfaction degrees $K_1$ and $K_2$ for each error cause are amended.

More specifically, if it is judged at step 345 that $X_1$ is larger than $\overline{X}_1$, the target theoretical air-fuel ratio cannot be obtained by the learning correction value $X_1$ for each error cause obtained by analyzing the error cause by using the satisfaction degree $K_1$ for each error cause, and it is meant that the learning correction value $X_1$ for each error cause is increased and amended at step 346. Accordingly, the routine goes into step 346, a predetermined small quantity $\Delta K_1$ is added to the present satisfaction degree $K_1$ for each error cause to set a new satisfaction degree $K_1$ for each error cause. At next step 348, $K_1$ is rewritten in the $K_1$-$K_2$ map, whereby the proportion of the separation into the deviation $K_1 \cdot \Delta\alpha$ by the F/I cause at the subsequent operation is increased and the learning correction value $X_1$ for each error cause is increased, with the result that increase amendment of the learning correction value $X_1$ for each error cause at step 342 becomes unnecessary or the degree of increase of $X_1$ is reduced.

On the other hand, if it is judged at step 345 that $X_1$ is smaller than $\overline{X}_1$, it is meant that decrease-amendment of the learning correction value $X_1$ for each error cause is made. Accordingly, the routine goes into step 347, and a predetermined minute quantity $\Delta K_1$ is subtracted from the present satisfaction degree $K_1$ for each error cause to set the new satisfaction degree $K_1$ for each error cause. At next step 348, rewriting of $K_1$ is performed, whereby the proportion of the separation into the deviation $K_1 \quad \Delta\alpha$ for each error cause by the F/I cause at the subsequent operation is reduced and the learning correction value $X_1$ for each error cause is reduced, with the result that decrease-amendment of the learning correction value $X_1$ for each error cause at step 343 becomes unnecessary or the degree of decrease of $X_1$ is reduced.

As is apparent from the foregoing description, if $X_1$ is not equal to $\overline{X}_1$, by increase-amendment or decrease-amendment of $X_1$, the satisfaction degree $K_1$ for each error cause is increased or decreased by the predetermined minute amount $\Delta K_1$ for the amendment, and the initially set satisfaction degree $K_1$ for each error cause is changed to an optimal value for the engine.

At steps 349 through 352, as in the case of the above mentioned amendment of the satisfaction degree $K_1$ for each error cause, the satisfaction degree $K_2$ for each error cause is amended to the optimal value according to whether the increase-amendment or the decrease-amendment is made on $X_2$, and the value on the map is rewritten, whereby the proportion of the deviation $K_2 \cdot \Delta\alpha$ by the Q cause is changed to the value optimal to the engine.

Accordingly, the portions of steps 342 through 352 correspond to the error cause analysis amending means L (or L'), and especially, the portions of steps 345 through 352 correspond to the analysis rule changing means $L_1$.

As is apparent from the foregoing description, in the case where the amendment by the error cause analysis amending means is necessary, the rule of the analysis of the error cause by the error cause analyzing means is not proper. Accordingly, the analysis rule is changed by the analysis rule changing means according to the amendment direction so that the amendment by the error cause analysis amending means becomes unnecessary and the analysis of the error cause is properly performed according to the engine.

If the values of the satisfaction degrees $K_1$ and $K_2$ for each error cause on the map are thus rewritten and the analysis rule is changed, the routine goes into step 353, and the learning correction values $X_1$ and $X_2$ for each error cause set at step 338 or the learning correction values $X_1$ and $X_2$ on each error cause amended at steps 342 and 343 are written on the predetermined address of RAM to effect rewriting of data. This RAM is a back-up memory, and the content of the memory is retained even after the engine key switch is turned off.

Accordingly, the portions of step 338, step 342 and step 343 correspond to the learning correction value setting means I for each error cause, and the portion of step 344 corresponds to the learning correction value renewal means for each error cause.

Figure 11:
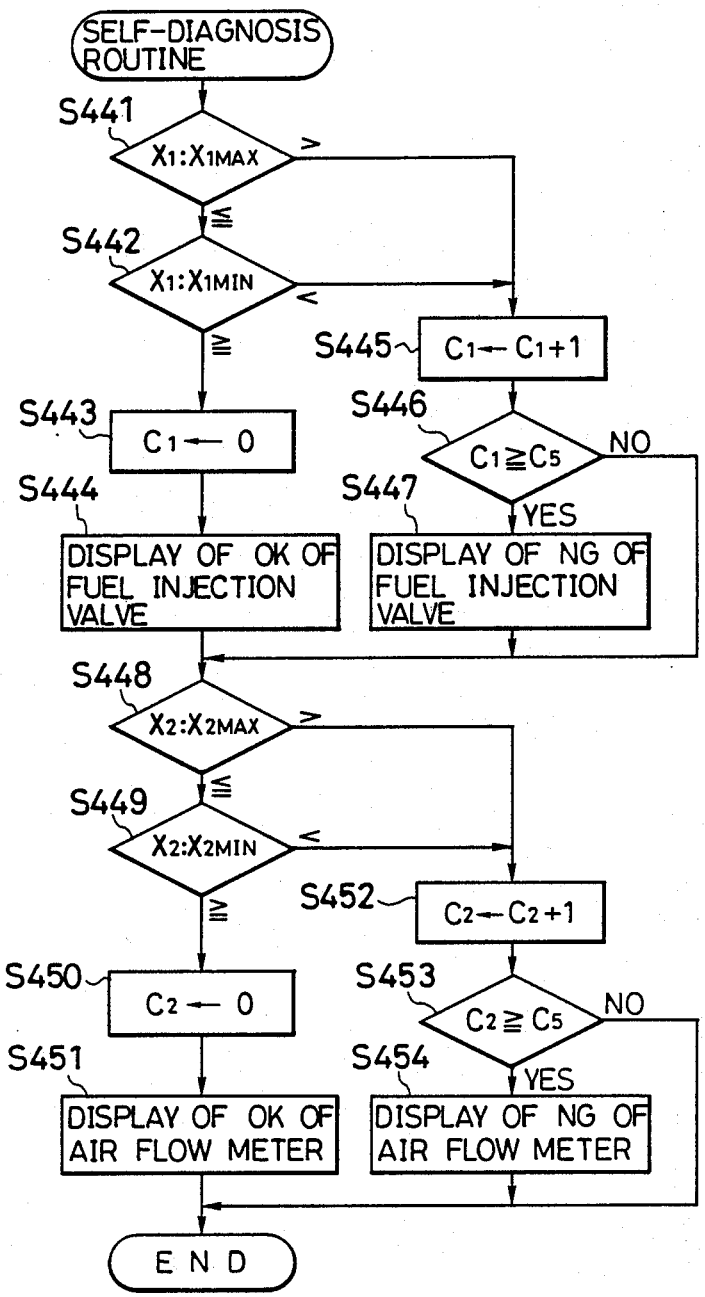
FIG. 11 is a flow chart of a self-diagnosis routine, which illustrates still another control content of the present invention.

In the present invention, the abnormal state-coping processing means can be added to the foregoing embodiments. This means performs an appropriate processing when the learning correction values $X_1$ and $X_2$ for each error cause exceeds a predetermined critical level for the judgement of an abnormal state. This means will now be described with reference to the self-diagnosis routine shown in FIG. 11. The routine is performed at predetermined time intervals, and the disorder or deterioration of the fuel injection valve 6 or the air flow meter 13 is checked.

More specifically, at step 441, the learning correction value $X_1$ for the F/I cause set at the above-mentioned optimal learning routine is compared with the upper limit value $X_{1max}$ of the abnormal state-judging value preliminary set.

In case of $X_1 \leqq X_{1max}$, the routine goes into step 442, and $X_1$ is compared with the lower limit value $X_{1min}$ and in case of $X_1 \geqq X_{1min}$, that is, in case of $X_{1min} \leqq X_1 \leqq X_{1max}$, the count value $C_1$ of the timer is cleared out at step 443. Then, at step 444, it is judged that the fuel injection valve is normal, and "OK" is displayed. If $X_1 \geqq X_{max}$ or $X_1 \leqq X_{1min}$ is judged at step 441 or 442, the routine goes into step 445, and the timer is started. At step 446, it is judged whether or not the count value $C_1$ of the timer is larger than the predetermined value Cs. In case of $C_1 \leqq Cs$, the routine goes into step 448 and if the condition of $C_1 \geqq Cs$ becomes satisfied, the routine goes into step 447, and it is judged that the fuel injection valve 6 is deteriorated and "NG" is displayed.

At steps 448 through 454, the air flow meter 13 is checked in the same manner as described above.

More specifically, at steps 448 and 449, it is judged whether or not the learning correction value $X_2$ for the Q cause relative to the air flow meter 13 is in the range of $X_{2min} \leqq X_2 \leqq X_{2max}$, and in case of $X_{2min} \leqq X_{2max}$, the count value $C_2$ of the timer is cleared out at step 450 and "OK" of the air flow meter 13 is displayed at step 451. In case of $X_2 < X_{2min}$ or $X_2 > X_{2max}$, the routine goes into step 452 and the timer is started, and if the count value $C_2$ is larger than the predetermined value Cs at step 453, "NG" is displayed at step 454.

Figure 12:
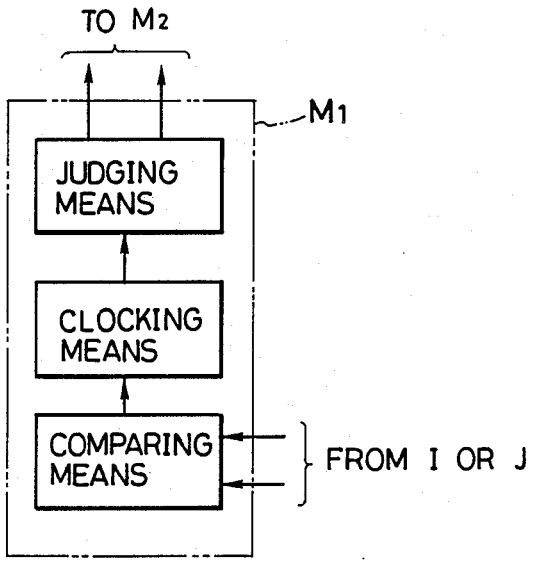
FIG. 12 is a functional block diagram of a part of the flow chart shown in FIG. 11, which illustrates one embodiment of the abnormal state-coping processing means of the present invention.

Accordingly, the portions of steps 441, 442, 448 and 449 correspond to the comparing means $M_{11}$ shown in FIG. 12, steps 445 and 452 correspond to the time measuring means $M_{12}$, steps 446 and 453 correspond to the judging means $M_{13}$, and the entire steps correspond to the abnormal state judging means $M_{14}$.

Incidentally, the setting time between the point of excess of the learning correction value for each error cause over the critical level for the judgement of an abnormal state and the point of the judgement of the abnormal state can be made different in the respective parts. The learning correction values $X_1$ and $X_2$ for each error cause can be put in from the learning correction value setting means I for each error cause or the learning correction value renewal means J for each error cause, as shown in FIG. 1.

By the comparing means $M_{11}$, the learning correction value for each error cause is compared with the preliminary set critical level for the judgement of the abnormal state, and if it is judged that the learning correction value for each error cause exceeds the critical level for the judgement of the abnormal state, the duration time of this state is measured by the time measuring means $M_{12}$. If the duration time exceeds a predetermined value, the judging means $M_{13}$ judges that deterioration or disorder is caused in a part relative to the learning correction value for each error cause. In addition to fatal disorder, deterioration of the part can be checked because the change of the characteristic by deterioration of the part can be detected. Moreover, erroneous judgement of an abnormal state can be prevented. Therefore, the reliability can be highly increased.

The abnormal state-coping processing means M may comprise learning regulating means $M_2$ which is arranged so that when the abnormal state judging means $M_1$ for each error cause judges an abnormal state of the learning correction value $X_1$ or $X_2$ for each error cause, the means $M_2$ regulates the corresponding value $X_1$ or $X_2$ to be renewed by the learning correction value renewal means J for each error cause to the upper limit value $X_{1max}$ or $X_{2max}$ or the lower limit value $X_{1min}$ or $X_{2min}$ and the regulated value is stored in the learning correction value storing means D for each error cause.

I claim:

1. An electronic learning control apparatus for an internal combustion engine, which comprises:

engine driving state detecting means for detecting the driving state of the internal combustion engine;

basic control quantity setting means for setting a basic control quantity corresponding to a target control value of an objective control factor;

feedback correction value setting means for comparing the actual control value with the target control value and setting a feedback correction value for bringing the actual control value close to the target control value by increasing or decreasing the actual control value;

rewritable learning correction value storing means for storing a learning correction value for each of a plurality of error causes, control quantity computing means for computing a control quantity by making a correction based on the learning correction value for each of the error causes according to a computing formula set for each of the error causes;

control means for controlling the objective control factor of the internal combustion engine according to the computed control quantity;

entire deviation detecting means for detecting the entire deviation of the feedback correction value from a predetermined reference value;

error cause analyzing means for analyzing qualitatively and quantitatively a cause for producing an error in said entire deviation according to a predetermined analysis rule and separating the entire deviation into deviations of the respective error causes based on the analysis results;

learning correction value setting means for computing and setting the learning correction value of each error cause based on the deviation of each error cause; and learning value renewal means for rewriting the learning correction value of each error cause stored in said storing means based on the set learning correction value of each error cause.

2. An electronic learning control apparatus for an internal combustion engine as set forth in claim 1, wherein the control quantity computing means is means for correcting the basic control quantity by the feedback correction value, dividing the error learning correction value stored in the learning correction value storing means for each error cause into addition and multiplication terms, correcting the basic control quantity according to said terms and thus computing the control quantity.

3. An electronic learning apparatus for an internal combustion engine as set forth in claim 1, wherein the error cause analyzing means comprises error cause satisfaction degree calculating means for analyzing a plurality of predetermined causes producing errors in the entire deviation according to predetermined analysis rules for the respective error causes and calculating the degree (satisfaction degree) of the satisfaction of the predetermined error cause in each analysis rule and deviation separating means for weighting each error cause based on the satisfaction degree in each error cause analysis rule and separating the entire deviation into deviations of the respective error causes.

4. An electronic learning control apparatus for an internal combustion engine as set forth in claim 3, wherein the error cause satisfaction degree calculating means is means for analyzing one error cause according to a plurality of analysis rules and averaging the error cause satisfaction degrees in the respective analysis rules.

5. An electronic learning control apparatus for an internal combustion engine as set forth in claim 3, wherein the analysis rule is a rule for determining the satisfaction degree according to at least one engine driving state.

6. An electronic learning control apparatus for an internal combustion engine as set forth in claim 5, wherein the analysis rule is a rule for determining the error cause satisfaction degree based on the entire deviation.

7. An electronic learning control apparatus for an internal combustion engine as set forth in claim 5, wherein the analysis rule is a rule for determining the error cause satisfaction degree according to the change speed of the entire deviation.

8. An electronic learning control apparatus for an internal combustion engine as set forth in claim 5, wherein the analysis rule is a rule for determining the error cause satisfaction degree according to the change direction of the entire deviation.

9. An electronic learning control apparatus for an internal combustion engine as set forth in claim 5, wherein the analysis rule is a rule for determining the error cause satisfaction degree according to the direction of the entire deviation in a plurality of different driving state areas determined according to a plurality of driving states.

10. An electronic learning control apparatus for an internal combustion engine as set forth in claim 5, wherein the analysis rule is a rule for calculating the error cause satisfaction degree based on the value of the quantity of air sucked in the engine per unit revolution of the engine and the frequency of appearance of the same quantity values within a predetermined time.

11. An electronic learning control apparatus for an internal combustion engine as set forth in claim 5, wherein the analysis rule is a rule for storing the satisfaction degrees based on a plurality of engine driving states and retrieving the error cause satisfaction degree according to the engine driving state detected by the engine driving state detecting means.

12. An electronic learning control apparatus for an internal combustion engine as set forth in claim 3, wherein the deviation separating means for each error cause is means for separating the entire deviation according to the ratios corresponding to the satisfaction degrees of the respective error causes.

13. An electronic learning control apparatus for an internal combustion engine as set forth in claim 3, wherein the learning correction value setting means for each error cause is means for obtaining a weighted means of the learning correction values for the respective error causes, stored in the learning correction value storing means for the respective error causes, and the deviations for the respective error causes, separated by the deviation separating means, in correspondence to the respective error causes to set present learning correction values for the respective error causes.

14. An electronic learning control apparatus for an internal combustion engine as set forth in claim 2, wherein the control quantity computing means is means for computing the control quantity Ti according to the following formula:

$$Ti = X_2 \cdot Tp \cdot COEF \cdot \alpha + (Ts + X_1)$$

wherein the control quantity Ti stands for the injection quantity of a fuel supplied to the internal combustion engine from a fuel injection valve, Tp stands for a basic fuel injection quantity corresponding to the quantity of air sucked per unit revolution of the engine, COEF stands for various correction coefficients corresponding to the engine driving state, $\alpha$ stands for the newest air-fuel ratio feedback correction coefficient determined by the feedback correction value setting means, Ts stands for a voltage correction quantity based on the battery voltage, and $X_1$ and $X_2$ each stands for a learning correction value for each error cause.

15. An electronic learning control apparatus, which comprises:

engine driving state detecting means for detecting the driving state of the internal combustion engine;

basic control quantity setting means for setting a basic control quantity corresponding to a target control value of an objective control factor;

feedback correction value setting means for comparing the actual control value with the target control value and setting a feedback correction value for bringing the actual control value close to the target control value by increasing or decreasing the actual control value;

rewritable learning correction value storing means for storing a learning correction value for each of a plurality of error causes;

control quantity computing means for computing a control quantity by making a correction of the basic control quantity based on the learning correction value for each of the error causes according to a computing formula set for each of the error causes;

control means for controlling the objective control factor of the internal combustion engine according to the computed control quantity;

entire deviation detecting means for detecting the entire deviation of the feedback correction value from a predetermined reference value;

error cause analyzing means for analyzing qualitatively and quantitatively a cause for producing an error in said entire deviation according to a predetermined analysis rule and separating the entire deviation into deviations of the respective error causes based on the analysis results;

error cause analysis result judging means for correcting and computing the basic control quantity without performing the feedback correction based on the new deviation for each error cause, separated by the error cause analysis means, comparing the obtained comparative control quantity with the preceding control quantity computed by the control quantity computing means and judging, based on the difference between said control quantities., whether or not the error cause analysis is proper;

error cause analysis amending means for increasing or decreasing and amending the new deviation for each error cause so that the difference between said control quantities based on the result of the judgement by the error cause analysis result judging means;

learning correction value setting means for computing and setting the learning correction value of each error cause based on the deviation of each of error causes, amended by said error cause amending means, and learning value renewal means for amending and rewriting the preceding learning correction value of each error cause stored in said storing means based on the set learning correction value of each error cause.

16. An electronic learning control apparatus for an internal combustion engine as set forth in claim 15, wherein the error cause analysis amending means further comprises analysis rule changing means for changing analysis rules in the error cause analysis means based on the amended deviations for the respective error causes.

17. An electronic learning control apparatus, which comprises:

engine driving state detecting means for detecting the driving state of the internal combustion engine;

basic control quantity setting means for setting a basic control quantity corresponding to a target control value of an objective control factor;

feedback correction value setting means for comparing the actual control value with the target control value and setting a feedback correction value for bringing the actual control value close to the target control value by increasing or decreasing the actual control value;

rewritable learning correction value storing means for storing a learning correction value for each of a plurality of error causes;

control quantity computing means for computing a control quantity by making a correction based on the learning correction value for each of the error causes according to a computing formula set for each of the error causes;

control means for controlling the objective control factor of the internal combustion engine according to the computed control quantity;

entire deviation detecting means for detecting the entire deviation of the feedback correction value from a predetermined reference value;

error cause analyzing means for analyzing qualitatively and quantitatively a cause for producing an error in said entire deviation and separating the entire deviation into deviations of the respective error causes based on the analysis results, learning correction value setting means for computing and setting the learning correction value of each error cause based on the deviation of each error cause;

learning value renewal means for rewriting the learning correction value of each error cause stored in said storing means based on the set learning correction value of each error cause; and abnormal state-copying processing means for judging the excess of the learning correction value for each error cause over a predetermined critical level for the judgement of an abnormal state and performing a processing for coping with the abnormal state.

18. An electronic learning control apparatus for an internal combustion engine as set forth in claim 17, wherein the abnormal state-coping processing means includes abnormal state-judging means which is arranged so that when the learning correction value for each error cause exceeds the predetermined critical level for the judgement of an abnormal state, it is judged that an abnormal state is brought about in a part relative to said learning correction value.

19. An electronic learning control apparatus for an internal combustion engine as set forth in claim 18, wherein the abnormal state judging means comprises comparing means for comparing the learning correction value for each error cause with the predetermined critical level for the judgement of an abnormal state, time measuring means for measuring the time during which the learning correction value for each error cause exceeds the critical level for the judgement of an abnormal state, time measuring means for measuring the time during which the learning correction value for each error cause exceeds the critical level for the judgement of an abnormal state and judging means which is arranged so that when the time measured by the time measuring means exceeds a predetermined value, it is judged that an abnormal state is brought about in a part relative to said learning correction value.

20. An electronic learning control apparatus for an internal combustion engine as set forth in claim 18, wherein the abnormal state-coping processing means includes learning regulating means for each error cause, which is arranged so that when the abnormal state is judged by the abnormal state judging means, the learning correction value for the corresponding error cause is regulated to an upper limit or lower limit value thereof.

* * * * *